United States Patent [19]

Smith et al.

[11] Patent Number: 4,647,031

[45] Date of Patent: Mar. 3, 1987

[54] GRIPPER FINGER DEVICE

[75] Inventors: David A. Smith, Midland; Herbert B. Geiger, Bay City, both of Mich.

[73] Assignee: The Dow Chemical Company, Midland, Mich.

[21] Appl. No.: 757,712

[22] Filed: Jul. 22, 1985

[51] Int. Cl.[4] ..... B65H 29/06

[52] U.S. Cl. ..... 271/82; 101/409

[58] Field of Search ..... 271/82, 204, 206; 198/803.9, 470.1; 101/408, 409, 410, 411

[56] References Cited

U.S. PATENT DOCUMENTS

| | | | |
|---|---|---|---|
| 2,530,412 | 11/1950 | Wallace | 198/803.9 |
| 2,773,585 | 7/1953 | Caulfield . | |
| 2,935,937 | 5/1960 | Rossetto | 101/409 X |
| 3,148,878 | 9/1964 | Eichorn . | |
| 3,269,524 | 10/1963 | Canfield . | |
| 3,534,683 | 10/1970 | Barthel | 271/82 X |
| 3,955,667 | 5/1976 | Muller et al. . | |
| 4,031,824 | 6/1977 | Bubley et al. . | |
| 4,058,307 | 11/1977 | Bubley et al. . | |
| 4,284,301 | 8/1981 | Geiger et al. . | |
| 4,358,466 | 11/1982 | Stevenson . | |
| 4,372,209 | 2/1983 | Jentzsch | 271/82 X |
| 4,381,056 | 4/1983 | Eberle . | |

*Primary Examiner*—Richard A. Schacher
*Attorney, Agent, or Firm*—L. E. Hessenaur, Jr.

[57] ABSTRACT

A device for engaging articles of varying thicknesses includes an anvil defining a gripping surface, a gripper finger assembly, and a finger actuator means for pivoting the gripper finger assembly with respect to the anvil. The gripper finger assembly includes a gripper finger, a finger support, and a spring which engages the finger and finger support and spring biases the finger into a neutral position with respect to the finger support. The finger may be moved out of its neutral position in either direction when forces in excess of predetermined forces are applied to the finger.

12 Claims, 12 Drawing Figures

GRIPPER FINGER DEVICE

BACKGROUND OF THE INVENTION

The present invention relates to apparatus for handling generally flat, flexible web products and, more particularly, to apparatus for conveying the products along a product path, removing the products from the path, and stacking the products.

Various equipment has been devised in the past to convey, stack, and package flexible web products, such as plastic food bags. Typically, such bags are conveyed along a path by a belt conveyor, engaged by grippers carried on a rotary support and removed from the path, and then deposited on a surface where they are stacked prior to being packaged.

Various difficulties have been encountered in handling such web type products. Such a plastic bag may, for example, include a zipper locking mechanism and, additionally, it may be gusseted or include wing-shaped pouch portions. One bag of this type is shown in U.S. Pat. No. 4,358,466, issued Nov. 9, 1982, to Stevenson. Even in a flat, folded position, a bag of this sort varies in thickness. As a consequence, when the bag is to be engaged by a number of gripping type devices simultaneously, allowance must be made for such variations in the bag thickness.

U.S. Pat. No. 4,284,301, issued Aug. 18, 1981, to Geiger et al teaches utilizing a spring-loaded jaw which can close in a manner to compensate for varying thicknesses of articles engaged by the jaw. By this arrangement, a number of jaws can be closed simultaneously with the same actuator mechanism. One pair of jaws is designed to rigidly clamp the product, while at least one other jaw is spring-loaded so that it can close to a different degree to compensate for the varying product thickness. While providing some advantages, the Geiger et al '301 gripper arrangement is nevertheless subject to damage from jams since only a small amount of variation in gripper position is permitted by the spring arrangement and, further, since pivoting of the gripper jaws independently is possible only in one direction, that is, away from the opposing gripper jaw.

U.S. Pat. No. 4,381,056, issued Apr. 26, 1983, to Eberle discloses a double acting gripping mechanism in which a gripper finger, constructed of a strip of spring steel, can be deflected in either of two directions. Even a small force causes deflection of the finger arrangement of Eberle, however, with the deflection distance being dependent upon the spring constant of the finger. Additionally, the amount of deflection is the same in either direction for a given force.

While it may be desirable to provide a gripper finger mechanism which can deflect away from a co-acting anvil or gripper structure so as to accomodate products of different thicknesses and to provide a gripper finger which can deflect toward the anvil or opposing gripper finger so as to limit the amount of damage occurs when products jam in the product path, nevertheless it is not always desirable that the deflection should be initiated at even the slightest force level, nor is it desirable that the threshold force levels for deflection in either direction be the same. Further, it may be advantageous to limit the amount of deflection permitted. It is seen, therefore, that there is a need for a device for engaging articles of varying thickness, including a plurality of gripper jaws, in which the gripper jaws can deflect in either of two directions, with the threshold force required to initiate deflection differing, and with the range of motion permitted in the two directions also differing.

SUMMARY OF THE INVENTION

This need is met by a device for engaging articles of varying thickness including anvil means defining a gripping surface; a gripper finger assembly means including a gripper finger, a finger support means, and a spring engaging the finger and finger support means; and a finger actuator means. The gripper finger assembly means includes a spring which spring biases the finger into a neutral position with respect to the finger support means, whereby the finger may be moved out of the neutral position in either direction when forces in excess of predetermined forces are applied to the finger. The finger actuator means pivots the finger support means such that the gripper finger may be brought into contact with the gripping surface.

The finger support means may include a pair of pivot posts extending generally parallel to the axis about which the finger support means is pivoted. The device may further have a gripper finger including a pair of plates disposed on either side of the finger support means and defining openings through which the ends of the pair of pivot posts extend. The openings are larger than the posts, whereby relative movement between the gripper finger and the finger support means is permitted by movement of either of the pivot posts within the openings. The spring may comprise a compression spring which is compressed between the gripper finger and the finger support means. The predetermined force for movement out of the neutral position in one direction may differ from that required for movement out of the neutral position in the other direction.

The device may be included as a part of apparatus for conveying flexible web products along a product path, removing the flexible web products from the product path, and stacking the flexible web products. The apparatus includes a conveyor means, the gripping means for engaging the products and removing them from the path, and means for receiving products from the gripping means.

The gripping means includes a shaft extending across the path therebeneath, a rotary support secured to the shaft, and a plurality of anvils mounted on the rotary support. A plurality of gripper finger assemblies are mounted on the rotary support, with each such gripper finger assembly including a gripper finger which may be pivoted into contact with an associated one of the anvils to engage a web product therebetween. The gripper fingers are each spring biased into a neutral position and moveable out of the neutral position toward the anvil or away from the anvil when forces in excess of predetermined force levels are applied to the finger. A means for moving the gripper fingers toward the anvils to engage the products and for moving the gripper fingers away from the anvils to release the products is provided. Finally, the gripping means includes means for rotating the rotary support.

The gripper finger assembly may further comprise finger support means, and a compression spring, engaging the finger and the support means, and spring biasing the finger into a neutral position with respect to the finger support means, whereby the gripper finger may be deflected in the event of jam conditions, thereby avoiding damage. The finger support means includes a pair of pivot posts extending generally parallel to the axis about which the rotary support is rotated. The gripper finger includes a pair of plates disposed on either side of the finger support means and defining openings through which the ends of the pair of pivot posts extend. The openings are larger than the posts to permit relative movement between the finger support means and the finger.

The pivot posts are spaced apart in a direction generally parallel to the gripper finger. The force required to move a gripper finger out of the neutral position toward the anvil differs from, and may be less than, the force required to move the gripper finger out of the neutral position away from the anvil. The sizes of the openings in the pair of plates determine the ranges of motion of the gripper finger in the two directions.

Accordingly, it is an object of the present invention to provide a device for engaging articles of varying thickness and apparatus into which the device is incorporated, in which a gripper finger which engages the articles may be moved from a spring biased neutral position in either of two directions when forces in excess of predetermined forces are applied to the finger; to provide such a device and apparatus in which the gripper finger co-acts with an opposing anvil means, with the gripper finger being moveable out of its neutral position either toward or away from the anvil means; to provide such a device and apparatus in which the amount of force required to move the gripper finger out of its neutral position differs in dependence upon the direction of movement; and to provide such a device and apparatus in which the ranges of movement of the finger are limited.

Other objects and advantages of the invention will be apparent from the following description, the accompanying drawings and the appended claims.

DETAILED DESCRIPTION OF THE PREFERRED EMBODIMENT

Figure 1:
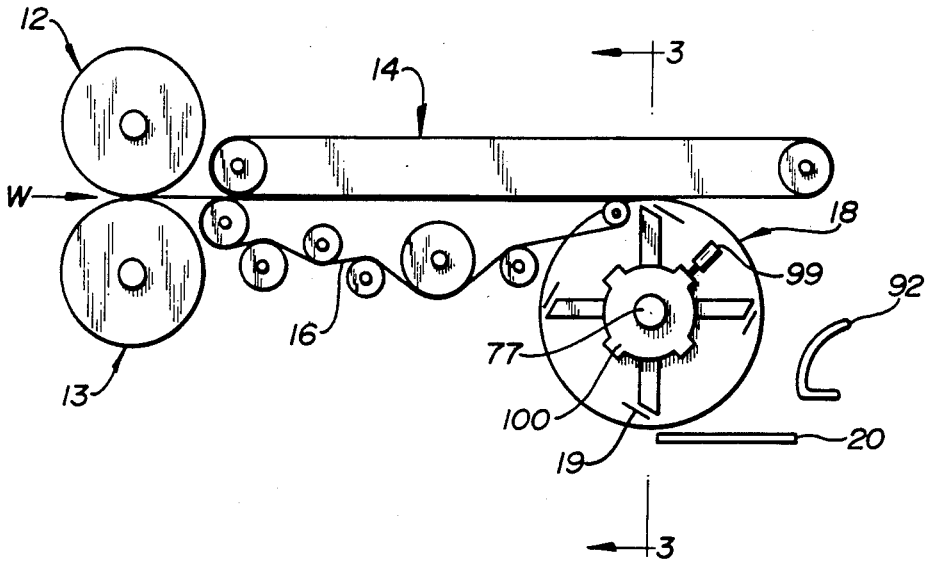
FIG. 1 is a side elevational view, partly schematic, illustrating apparatus according to the present invention.
Figures 1A, 1B, 1C, 1D:
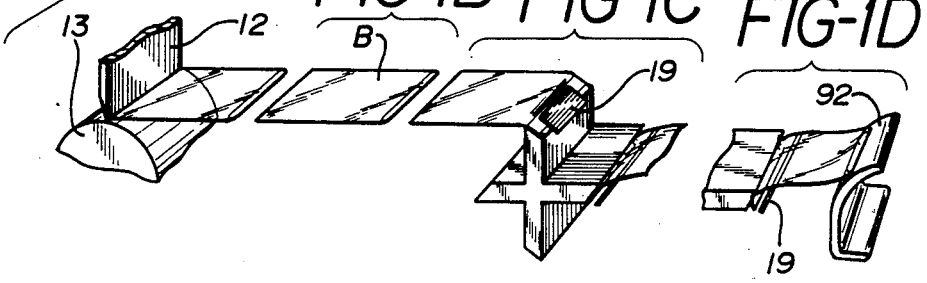
FIGS. 1A–1D are schematic perspective views of a sequence of steps performed by the apparatus of FIG. 1.
Figure 3:
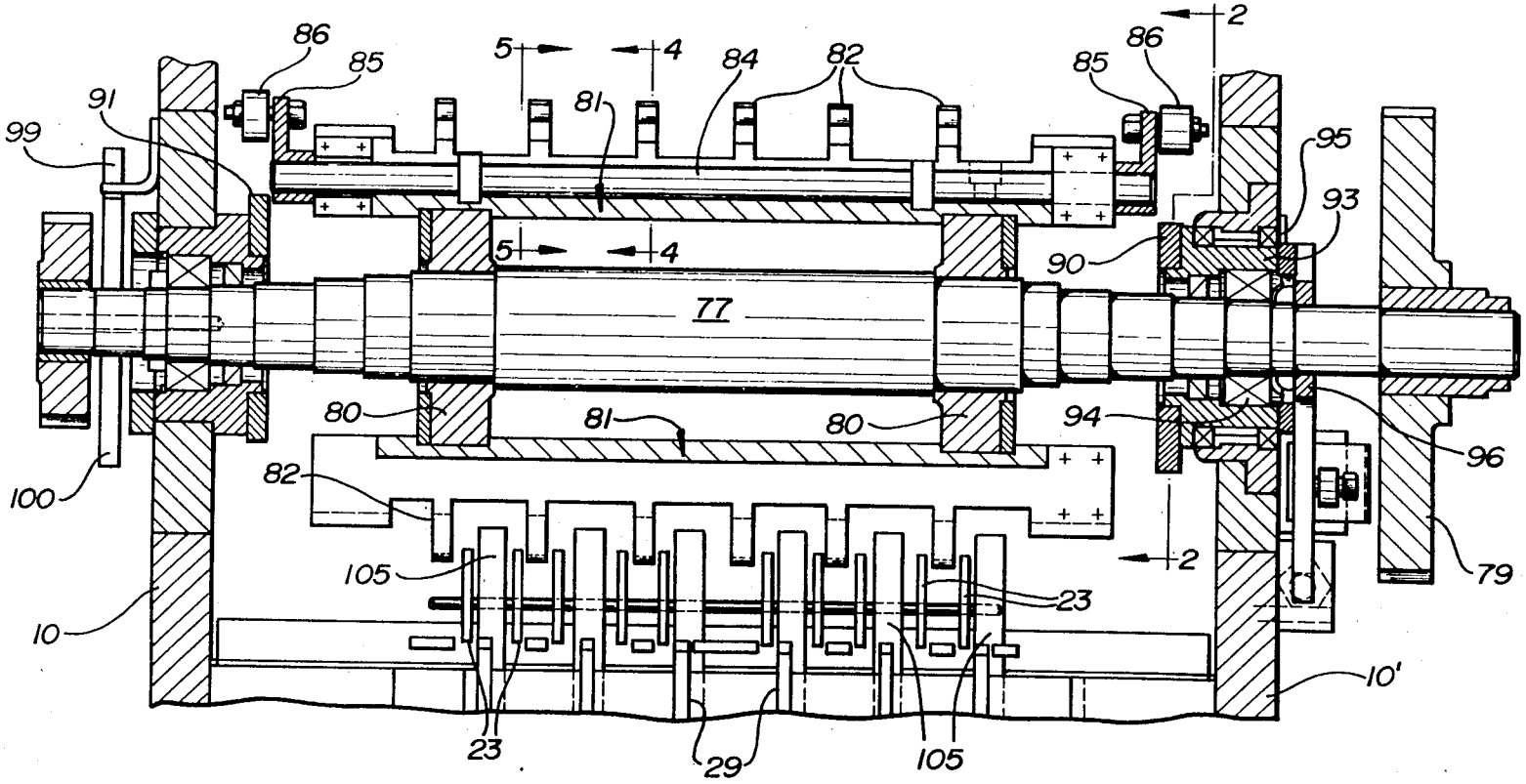
FIG. 3 is a transverse sectional view, taken generally along line 3—3 in FIG. 1, showing particularly the arrangement of the gripping means.

Reference is initially made to FIGS. 1 and 3, and to FIGS. 1A–1D by which the overall function of the apparatus may be best understood. A series of web products, such as plastic bags B, are formed by cutting the web with a knife roll 12 operating against an anvil roll 13. After a bag is formed, it enters a conveyor generally designated 14 which includes an upper belt run 15 and a lower belt run 16. The belts 15 and 16 are preferably operated at a faster speed than the speed of the web entering the cut-off station. This results in the bags being spaced apart, as shown in FIG. 1B. The upper belt 15 is made of screen-type material which runs under a vacuum box or manifold 17.

The bags are delivered to a first gripping means, generally designated 18, which is made up of a plurality of grippers 19. The grippers sequentially grip the bags B in the transport path defined by the belt system 14 and move the bags in sequence around an arcuate path for deposit on a stacking surface 20. A guide 92 assists in depositing the bags smoothly on the surface 20. After a predetermined number of bags have been deposited on the elevator 20, an appropriate detector responsive to rotation sensor 99, causes the stack of bags to be removed from surface 20 by a transport (not shown, permitting a new stacking to be initiated.

Figure 2:
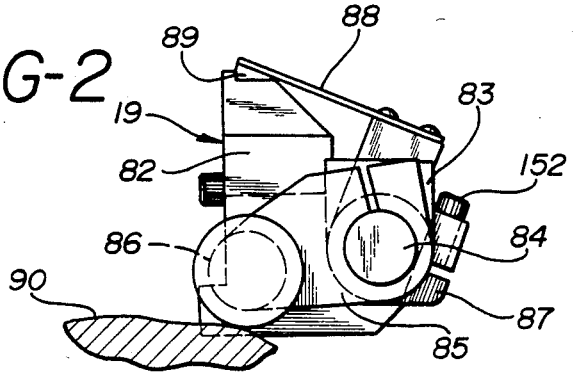
FIG. 2 is an enlarged fragmentary side elevational view of a gripper finger assembly means, an anvil means, and an actuator means, as seen generally along line 2—2 in FIG. 3, with a portion of the cam in section.

Referring to FIGS. 2 and 3, it may be seen that the numeral 77 designates a driven shaft, rotatably mounted in the frame elements 10 and 10'. The gear drive to this shaft is omitted from FIG. 3, but may include a gear train cooperating with gear 79 which is mounted on the end of gripper shaft 77. A pair of spiders 80, mounted on the shaft 77, carry four anvil supports 81, positioned 90 degrees apart. Each anvil support 81, in turn, carries a plurality of anvils 82 and block 83 which support actuation shaft 84 carried by a block 83. Clamped to the shaft 84 at each end is a cam follower arm 85 carrying a cam follower 86. Also fixed to the actuator shaft 84 are a plurality of finger support means 87 which each carries a gripper finger 88. Each gripper finger 88 cooperates with an associated anvil 82 in gripping web products. In particular, each anvil 82 has a notch at the upper portion thereof confronting the finger 88, which notch includes a pad 89 defining a gripping surface.

The cam 90 which actuates the cam follower 86 is shown in fragmentary form in FIG. 2. The cam 90 operates against the right hand cam follower 86, as seen in FIG. 3, to close the gripper fingers 88 against the pad 89. The cam follower 86 operates against a cam 91 on the left hand side of FIG. 3 to open the gripper fingers 88, and thus release the web product onto the surface 20. The positions of cams 90 and 91 may be independently adjusted to control independently the opening and closing of the grippers.

Figure 4A:
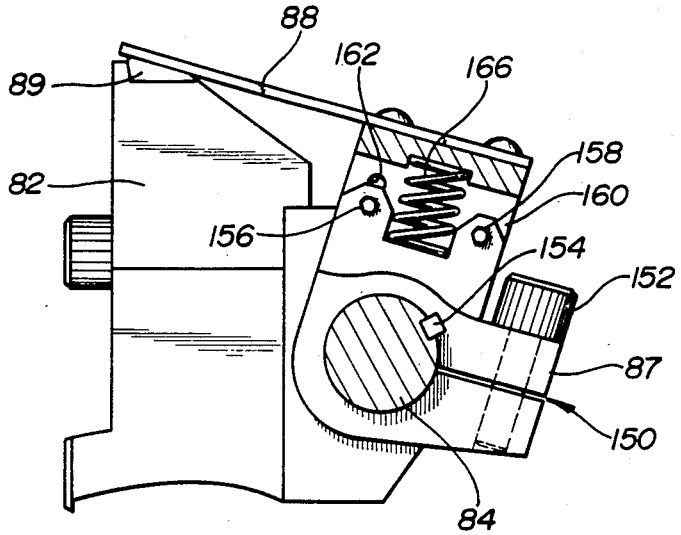
FIGS. 4A and 4B are enlarged sectional views, taken generally along line 4—4 in FIG. 3, showing the gripper finger assembly means pivoted into and out of contact, respectively, with the gripping surface of an anvil means.
Figure 4B:
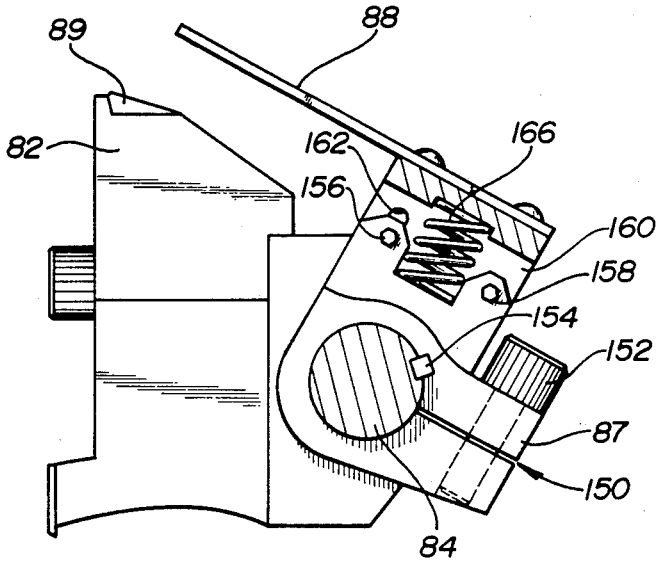

The finger actuator means, including actuator shaft 84 pivots the finger support means 87 between an open position, shown in FIG. 4B, and a closed position, shown in FIG. 4A, in which a product is gripped between the pad 89 and the finger 88. The finger support means 87 defines a slot 150 which is bridged by bolt 152. Bolt 152, when tightened, presses together opposite sides of the slot 150 and thereby secures means 87 to shaft 84. Shaft 84 also has associated with it a key 154 which ensures that the finger support means 87 pivots with the shaft 84.

Figure 5A:
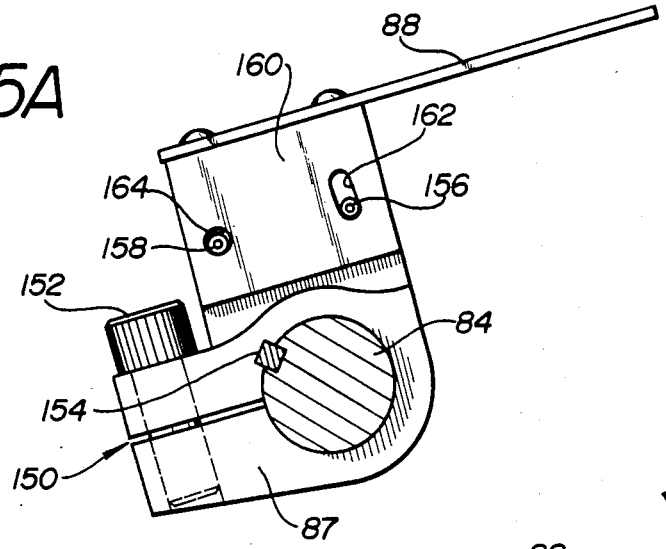
FIGS. 5A, 5B, and 5C are enlarged sectional views taken generally along line 5—5 in FIG. 3, illustrating the gripper finger in its neutral position, in a position moved toward the anvil means, and in a position moved away from the anvil means, respectively.
Figure 5B:
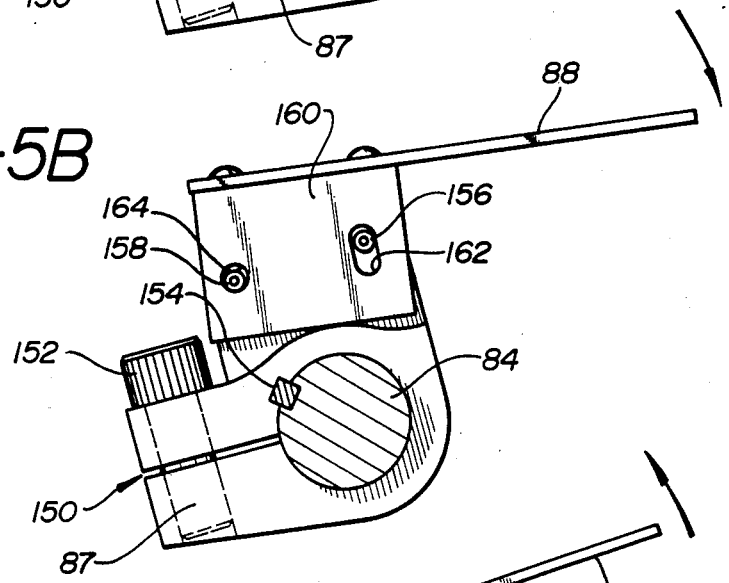
Figure 5C:
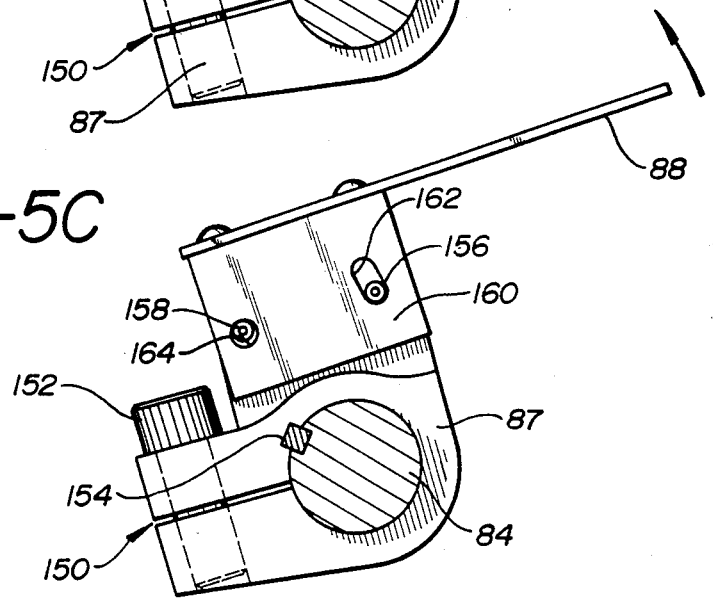

FIG. 5A illustrates the finger 88 in its neutral position with respect to the finger support means 87; FIG. 5B illustrates the finger 88 moved out of the neutral position in a direction generally toward the anvil 82; and FIG. 5C illustrates the finger 88 moved out of the neutral position in a direction generally away from the anvil 82. To permit this movement of the finger 88, the finger support means includes a pair of pivot posts 156 and 158 which extend generally parallel to the axis of the shaft 84, completely through support 87. The gripper finger 88 includes a pair of plates 160 which are disposed on either side of the finger support means 87 and which define openings 162 and 164 through which the ends of pivot posts 156 and 158 extend, respectively. As may be noted, openings 162 and 164 are larger than posts 156 and 158, whereby relative movement between the gripper finger 88 and the finger support means 87 is permitted by the relative movement of either of the posts 156 or 158 within the openings 162 and 164. This is best seen in FIGS. 5B and 5C.

The gripper finger assembly further includes a compression spring 166 which engages the finger 88 and the support means 87, and spring biases the finger 88 into its neutral position. Spring 166 is compressed between support 87 and finger 88, and positions posts 156 and 158 against the sides of the respective openings 162 and 164 closest to the shaft 84, as shown in FIG. 5A.

It will be appreciated that for finger 88 to be deflected out of its neutral position, a deflection force must be applied to the finger 88 which overcomes the opposing force of the spring 166, and this must occur before any movement is produced. It will be further appreciated that the movement of finger 88 in either of the two directions is generally a pivoting type movement, and that this movement involves pivoting of finger 88 about the post 158 when the movement is generally toward the anvil, as shown in FIG. 5B, and pivoting of finger 88 about the post 156 when the movement of the finger 88 is generally away from the anvil. Since the spring 166 is positioned intermediate the posts 158 and 156, it opposes movement of the finger 88 in either direction by applying substantially the same force moment to the finger 88.

It will be appreciated that the force required to overcome spring 166 and pivot the finger 88 as shown in FIG. 5C is greater than the force required to pivot the finger 88 in the opposite direction, as shown in FIG. 5B (assuming that the forces are applied to the same point on the finger 88). This is because the distance from the end of the gripper finger 88 to post 158 is greater than the distance from the end of the finger 88 to the post 156. Since the lever arm to post 158 is longer, less force is required to overcome the opposing force of the compression spring 166.

By selecting appropriate spacing between the posts 156 and 158, and the spring 166, as well as the spring constant of spring 166, the force levels required for deflection of the finger 88 in either direction may generally be set at predetermined desired levels. It should also be noted that the openings 162 and 164 may be sized to provide for differing ranges of motion of the finger 88 in the two directions.

Having described the invention in detail and by reference to preferred embodiments thereof, it will be apparent that modifications and variations are possible without departing from the scope of the invention defined in the appended claims.

What is claimed is:

1. A device for engaging articles of varying thicknesses, comprising:

anvil means defining a gripping surface, gripper finger assembly means including a gripper finger, finger support means for supporting said gripper finger such that said finger may be pivoted with respect thereto from a neutral position either toward or away from said anvil means, and a spring engaging said finger and finger support means and spring biasing said finger into a neutral position with respect to said finger support means, whereby said finger may be moved out of said neutral position in either direction when forces in excess of predetermined forces are applied to said finger, finger actuator means for pivoting said finger support means such that said gripper finger is moved toward said gripping surface, so as to engage an article therebetween.

2. The device of claim 1 in which said finger support means includes a pair of pivot posts extending generally parallel to the axis about which said finger support means is pivoted, and in which said gripper finger includes a pair of plates disposed on either side of said finger support means and defining openings through which the ends of said pair of pivot posts extend, said openings being larger than said posts whereby relative movement between said gripper finger and said finger support means is permitted by movement of either of said pivot posts within said openings.

3. The devices of claim 2 in which said spring comprises a compression spring compressed between said gripper finger and said finger support means.

4. The device of claim 2 in which the range of movement of the finger out of said neutral position is determined by the size of said openings.

5. The device of claim 1 in which the predetermined force required for movement out of the neutral position in one direction differs from that required for movement out of the neutral position in the other direction.

6. Apparatus for conveying flexible web products along a product path, removing said flexible web products from said product path, and stacking said flexible web products, comprising:

a conveyor means for transporting said products along said path, gripping means for engaging said products and removing said products from said path, said gripping means including a shaft extending across said path therebeneath, a rotary support secured to said shaft, a plurality of anvils mounted on said rotary support, a plurality of gripper finger assemblies mounted on said rotary support, each such gripper finger assembly including a gripper finger which may be pivoted toward an associated one of said anvils to engage a web product therebetween, said gripper fingers each being spring biased into a neutral position and movable out of said neutral position toward said anvil when forces in excess of predetermined force levels are applied to said finger, means for moving said gripper finger assemblies toward said anvils such that said fingers engage said products and for moving said gripper finger assemblies away from said anvils such that said fingers release said products, and means for rotating said rotary support, and means, positioned adjacent said gripping means, for receiving products from said gripping means after they are removed from said path.

7. The apparatus of claim 6 in which each said gripper finger assembly further comprises:

a finger support means, and a compression spring engaging said finger and said support means and spring biasing said finger into a neutral position with respect to said finger support means, whereby said gripper finger may be deflected either toward or away from its associated anvil in the event of jam conditions, thereby avoiding damage.

8. The apparatus of claim 7 in which said finger support means includes a pair of pivot posts extending generally parallel to the axis about which said rotary support is rotated, and in which said gripper finger includes a pair of plates disposed on either side of said finger support means and defining openings through which the ends of said pair of pivot posts extend, said openings being larger than said posts to permit relative movement between said finger support means and said finger.

9. The apparatus of claim 8 in which said pivot posts are spaced apart in a direction generally parallel to said gripper finger.

10. The apparatus of claim 8 in which the size of said openings in said pair of plates determines the range of motion of said gripper finger.

11. The apparatus of claim 6 in which the force required to move a gripper finger out of said neutral position toward said anvil differs from the force required to move a gripper finger out of said neutral position away from said anvil.

12. The apparatus of claim 11 in which the force required to move a gripper finger out of said neutral position toward said anvil is less than the force required to move a gripper finger out of said neutral position away from said anvil.

* * * * *